US005394665A

United States Patent [19]

Johnson

[11] Patent Number: 5,394,665

[45] Date of Patent: Mar. 7, 1995

[54] STUD WALL FRAMING CONSTRUCTION

[76] Inventor: Gary Johnson, 2724 Nathan Ave., Modesto, Calif. 95354

[21] Appl. No.: 147,518

[22] Filed: Nov. 5, 1993

[51] Int. Cl.[6] ..... E04C 2/38; E04C 3/04

[52] U.S. Cl. ..... 52/241; 52/243; 52/481.1; 52/656.9; 52/731.9; 52/735; 52/731.5; 52/745.09; 52/745.1; 52/105

[58] Field of Search ..... 52/690, 241, 243, 290, 52/481.1, 105, 731.9, 735, 745.05, 745.09, 745.1, 731.5, 656.9, 656.1; 403/230, 245; 29/432, 513, 514, 525, 897.3, 897.31, 897.312

[56] References Cited

U.S. PATENT DOCUMENTS

| | | | |
|---|---|---|---|
| 1,515,159 | 11/1924 | Morrison | 403/230 |
| 2,410,922 | 11/1946 | Balduf | 52/248.1 X |
| 3,082,850 | 3/1963 | Weening | 52/127.5 |
| 3,536,345 | 10/1970 | Leifer . | |
| 3,680,271 | 8/1972 | Satchell | 52/241 X |
| 3,934,327 | 1/1976 | Hafner | 29/432 |
| 3,999,352 | 12/1976 | Doke | 52/690 |
| 4,333,672 | 6/1982 | Arthur et al. | 29/432 X |
| 4,805,364 | 2/1989 | Smolik . | |
| 4,835,935 | 6/1989 | Murphy . | |
| 4,854,096 | 8/1989 | Smolik . | |
| 4,918,899 | 4/1990 | Karytinos | 52/241 X |
| 5,157,883 | 10/1992 | Meyer . | |
| 5,203,132 | 4/1993 | Smolik . | |
| 5,222,335 | 6/1993 | Petrecca . | |
| 5,237,734 | 8/1993 | Polon | 29/513 |

*Primary Examiner*—Carl D. Friedman
*Assistant Examiner*—Robert J. Canfield
*Attorney, Agent, or Firm*—Shlesinger, Arkwright & Garvey

[57] ABSTRACT

A stud wall framing construction comprises a lower track; an upper track aligned with and vertically spaced from the lower track; and a plurality of vertically aligned studs positioned between the lower and upper tracks. The lower and upper end portions of the studs are positioned within the lower and upper tracks, respectively. Each of the lower and upper tracks includes a channel with opposed track sidewalls and a track base wall. The track sidewalls have a plurality of inwardly projecting track protrusions formed from the sidewalls. Each of the track protrusions on one of the sidewalls is paired with another track protrusion disposed across the opposite sidewall. The lower and upper end portions of the studs has opposed stud sidewalls and plurality of inwardly projecting stud protrusions formed from the stud sidewalls. Each of the stud protrusions on one of the stud sidewalls is paired with another stud protrusion disposed across the opposite stud sidewall. The track and stud protrusions are adapted such that each of the pair track protrusions nest into a respective pair of stud protrusions, thereby locking the studs in the tracks.

19 Claims, 2 Drawing Sheets

STUD WALL FRAMING CONSTRUCTION

FIELD OF THE INVENTION

The present invention relates generally to a stud wall framing construction and particularly to metal stud wall framing assembly without using screws.

BACKGROUND OF THE INVENTION

In modern commercial and residential construction, the standard wooden studs in load-bearing and non-load bearing walls are being replaced by metal studs and tracks for several reasons, such as fire resistance considerations, ease of handling, reduced storage space, availability of wooden studs, etc.

The installation of the metal studs into the metal tracks are typically accomplished by means of self-tapping screws securing the end portions of the studs that are received within the metal tracks. This installation is relatively time-consuming, since in addition to the time required to drive the screws, the tracks have to be marked off at regular intervals to indicate where the studs will be positioned prior to securing with the screws. Also, where the framing is being assembled on the floor, time is involved in tilting the assembly over after the first side has been secured with screws to expose the other side to secure that side with screws.

There is therefore a need for metal stud framing construction that saves relatively substantial amount of time by doing away with using screws to secure the studs to the tracks and having the tracks pre-marked at regular intervals for locating the studs therealong.

OBJECTS AND SUMMARY OF THE INVENTION

It is an object of the present invention to provide a stud wall framing construction that is assembled without using screws.

It is another object of the present invention to provide a metal stud framing construction wherein the tracks are pre-marked at regular intervals at locations where the studs are to be secured.

It is still another object of the present invention to provide a metal stud wall framing construction where the studs snap in place into the tracks and secures the studs laterally and vertically.

It is yet another object of the present invention to provide a metal stud wall framing construction that uses an assembly means that is relatively inexpensive to manufacture.

In summary, the present invention provides a metal stud wall framing construction where the studs and the tracks include built-in securing means that snap together at predetermined intervals, thereby avoiding the use of screws during assembly and saving installation time.

These and other objects of the present invention will become apparent from the following detailed description.

BRIEF DESCRIPTIONS OF THE DRAWINGS

DETAILED DESCRIPTION OF THE INVENTION

Figure 1:
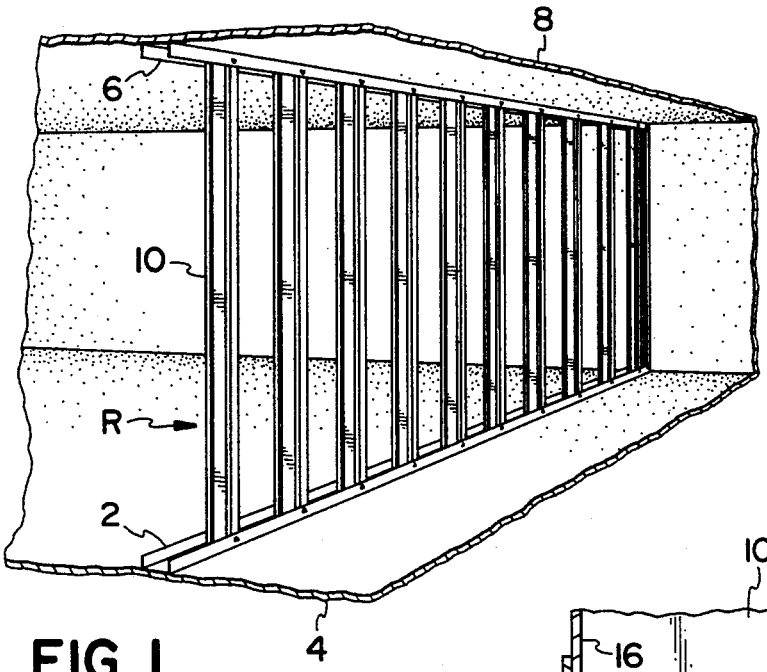
FIG. 1 is a fragmentary perspective view of a stud wall framing construction using the present invention.

A stud wall framing section R assembled together utilizing the present invention is disclosed in FIG. 1. The framing section R comprises a lower track 2 secured horizontally to a structural floor member 4, an upper track 6 secured horizontally to an upper floor structural member 8 or the like and a plurality of vertical studs 10 secured to the tracks 2 and 6 using the present invention. The framing section R is typically covered with drywall paneling (not shown) or the like on both sides to form a partition wall between two rooms. The framing section R may also be used for framing outside walls.

Figure 2:
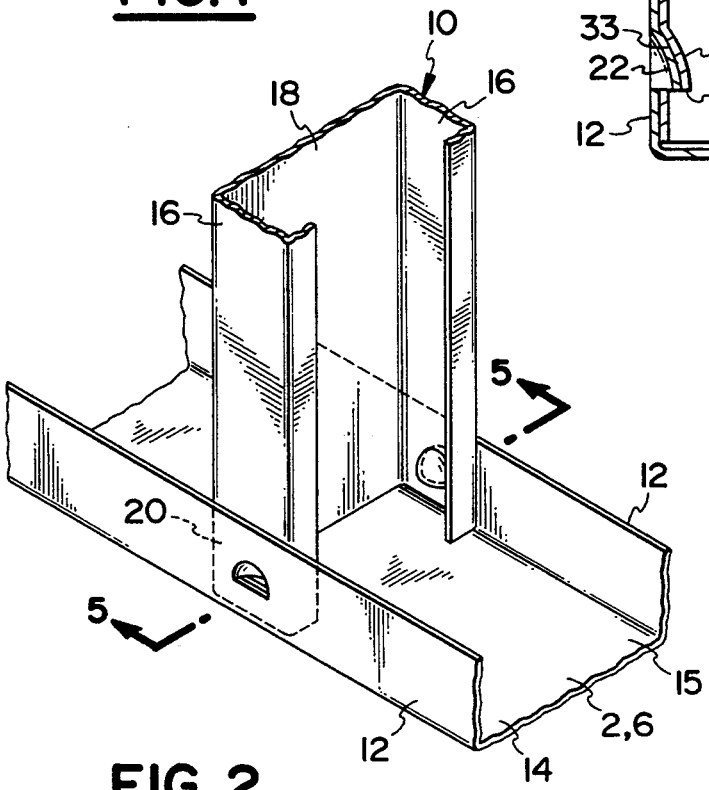
FIG. 2 is an enlarged fragmentary perspective view of a stud secured to a track using the present invention.

The tracks 2 and 6 have identical cross-section and substantially rectangular "C"- or "U"-shaped, as best shown in FIG. 2. Each of the tracks 2 and 6 have opposing sidewalls 12 and a connecting base wall 14, thereby forming a channel 15. Each of the studs 10 is substantially rectangular "C"-or "U"-shaped with opposing sidewalls 16 and a connecting base wall 18, as best shown in FIG. 2. An end portion 20 of each stud is received within the respective tracks 2 and 6 between the sidewalls 12. The tracks 2 and 6 and the studs 10 are typically formed from hot dipped galvanized rolled steel in various gauges such as 14, 16, 18, 20 and 24 gauge metal. The studs 10 are advantageously secured to the tracks 2 and 6 such that the base walls 18 are substantially perpendicular to the sidewalls 12.

Figure 5:
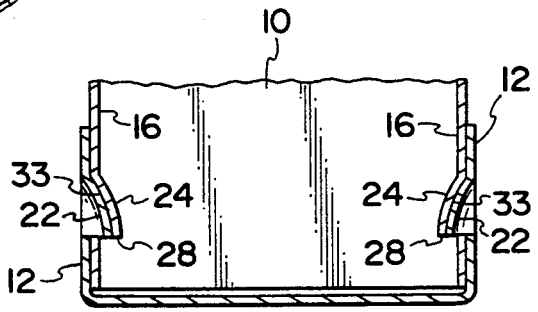
FIG. 5 is a fragmentary cross-section view taken along line 5—5 in FIG. 2.
Figure 4:
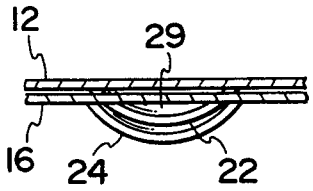
FIG. 4 is a cross-sectional view taken along line 4—4 in FIG. 3.
Figure 3:
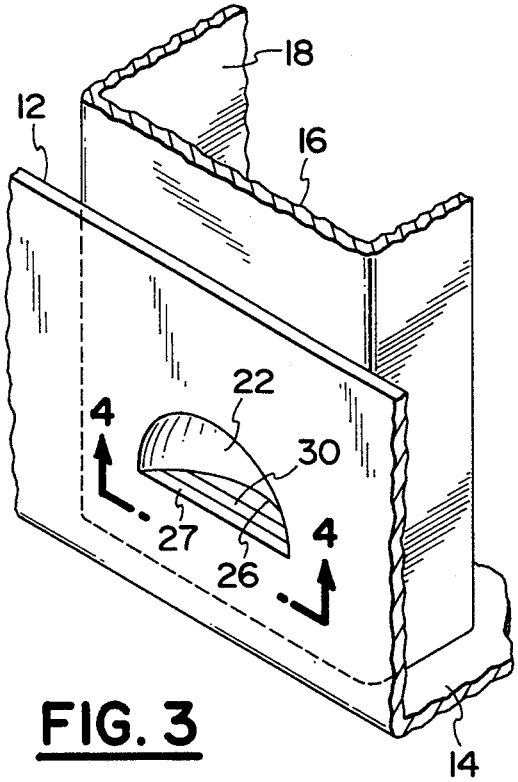
FIG. 3 is an enlarged fragmentary perspective view of a sidewall of the track of FIG. 2.

Each of the tracks 2 and 6 is formed with inwardly projecting arcuate protrusions or dimples 22 disposed at regular intervals along the sidewalls 12, as best shown in FIGS. 2 and 3. The end portion 20 of each stud 10 is provided with corresponding inwardly projecting arcuate protrusions 24 that have similar shape as the protrusions 22 such that they nest together when the studs 10 are secured to the tracks 2 and 6, as best shown in FIGS. 2, 4 and 5. Each of the protrusions 22 has a shoulder or base 26 that is formed from the respective sidewall 12 and extends beyond the respective sidewall 16 of the stud 10, as best shown in FIG. 3. A ledge 27 is formed when the shoulder 26 is formed. Similarly, each of the protrusions 24 is formed from the respective sidewall 16 with a shoulder or base 28 and a ledge 30, as best shown in FIG. 3.

The protrusions 22 and 24 are formed such that when the end portions of the studs 10 are snapped in place into the tracks 2 and 6, the studs 10 are square with the tracks 2 and 6.

Figure 6:
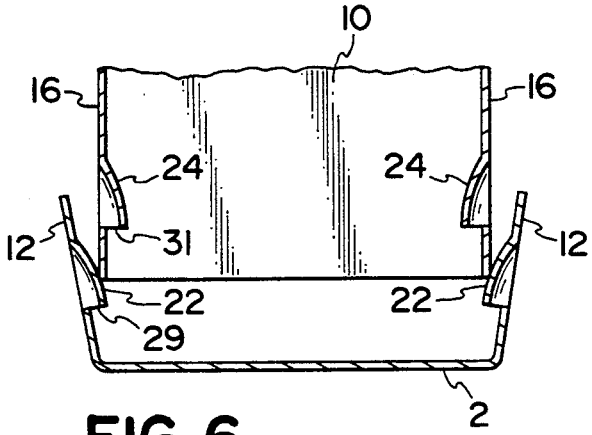
FIG. 6 is an enlarged, schematic and fragmentary cross-sectional view of a stud being forced into a track.

Each of the studs 10 is secured to the tracks 2 and 6 by vertically aligning the protrusions 24 above the protrusions 22 and forcing the stud 10 downwardly into the tracks 2 and 6, as best shown in FIG. 6. The studs 10 may also be secured to the tracks 2 and 6 by twisting them into place. The sidewalls 12 and 16 of the tracks 2 and 6 and the studs 10 are advantageously resilient to permit the studs 10 to be forced in place. The sidewalls 12 are advantageously resiliently biased inwardly to provide compressive force on the end portions 20 of the studs 10. The protrusions 22 are advantageously ramped to permit the studs 10 to be forced in. Once the studs 10 are forced in place and the respective protrusions 22 and 24 are nested together, the ledges 30 on respective sidewalls 16 engage the respective shoulders 26 of the protrusions 22, thereby preventing vertical withdrawal of the studs 10, as best shown in FIGS. 3 and 5. The nesting of the respective protrusions 22 and 24 advantageously prevent lateral motion between the studs 10 and the tracks 2 and 6.

Each of the protrusions 22 and 24 is formed by cutting a horizontal slot on the respective sidewall 12 or 16 and forcing the portion of the sidewall above the slot inwardly into the track or stud such that the slot is formed into an opening 29 or 31, as best shown in FIG. 6. The deformation of the sidewalls 12 and 16 create the ledges 27 and 30 and the shoulders 26 and 28.

Each protrusion 24 includes a cavity 33 that is adapted to receive the respective protrusion 22, as best shown in FIGS. 4 and 5. Close fit between the outer surface of each protrusion 22 and the inner surface of a respective protrusion 24 advantageously minimizes lateral and vertical movements of the studs with respect to the tracks.

Figure 8:
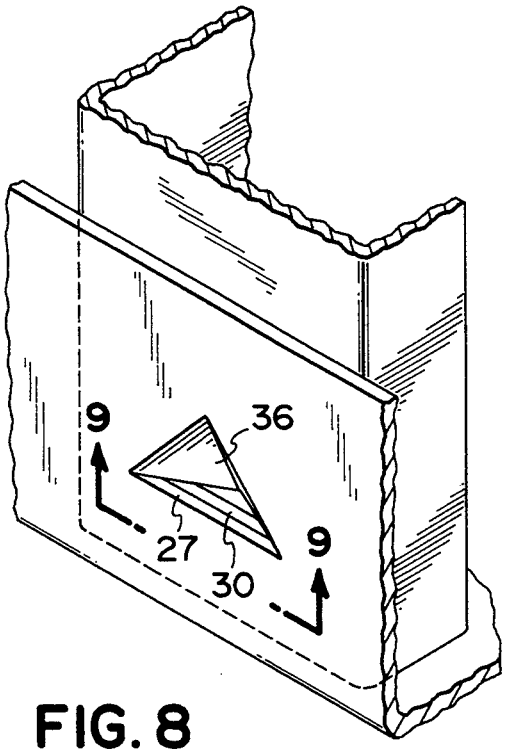
FIG. 8 is an enlarged fragmentary perspective view of a sidewall of the track of FIG. 7.
Figure 7:
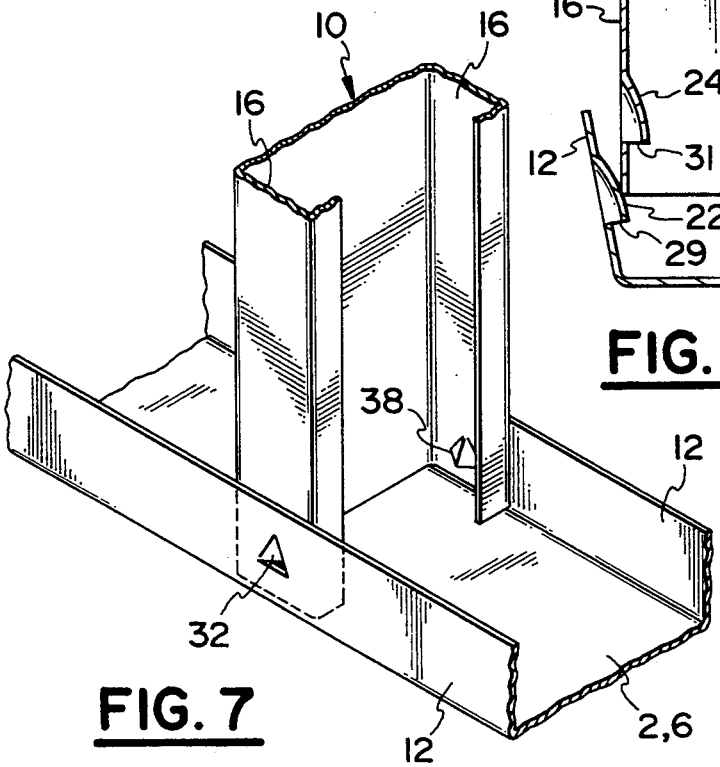
FIG. 7 is an enlarged fragmentary perspective view of a stud secured to a track using another embodiment of the present invention.
Figure 9:
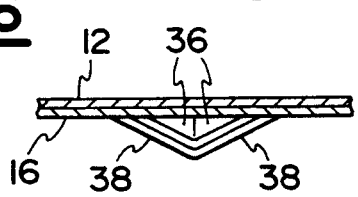
FIG. 9 is a cross-sectional view taken along line 9—9 in FIG. 8.

Another embodiment of the present invention is disclosed in FIG. 7. Protrusions 32 on the sidewalls 12 of the track 2 cooperate with protrusions 34 on the sidewalls 16 of the stud 10. The protrusions 32 and 34 are similar in operation to the protrusions 22 and 26, except that the protrusion 32 and 34 have triangular faces 36 and 38, as best shown in FIGS. 7, 8 and 9. The triangular shapes of the protrusions 32 and 34, which form part of a tetrahedron, advantageously provide relatively more definite positioning and aligning of the studs 10 with respect to the tracks 2 and 6.

Although the present invention has been disclosed using metal studs, it may also be applicable for other studs made from other resilient materials, such as plastic, etc.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A stud wall framing construction, comprising:

a) a lower track;

b) an upper track aligned with and vertically spaced from said lower track;

c) a plurality of vertically aligned studs positioned between said lower and upper tracks;

d) each of said studs having lower and upper end portions being positioned within said lower and upper tracks, respectively;

e) each of said lower and upper tracks including a channel having opposed track sidewalls and a track base wall;

f) each of said track sidewalls having a plurality of inwardly projecting prefabricated track protrusions formed from said sidewalls, each of said track protrusions on one of said sidewalls being paired with another track protrusion disposed on the opposite sidewall;

g) each of said lower and upper end portions of said studs having opposed stud sidewalls and a stud base wall;

h) each of said stud sidewalls having a plurality of inwardly projecting stud prefabricated protrusions formed from said stud sidewalls, each of said stud protrusions on one of said stud sidewalls being paired with another stud protrusion disposed on the opposite stud sidewall; and i) said track and stud protrusions are adapted such that each of said pair of track protrusions nest into a respective said pair of stud protrusions, thereby locking the studs in said lower and upper tracks.

2. A framing construction as in claim 1, wherein:

a) each of said stud and track protrusions includes a ramp portion.

3. A framing construction as in claim 1, wherein:

a) each of said stud and track protrusions includes shoulder portions, and said track and stud sidewall portions adjacent said shoulder portions include ledge portions; and b) each of said track shoulder portions extends inwardly into the respective stud sidewall and beyond said ledge portion of the respective stud.

4. A framing construction as in claim 3, wherein:

a) said shoulder of each of said track protrusions engages said ledge portion of the respective stud protrusion such that vertical movement of each of said studs is resisted.

5. A framing construction as in claim 1, wherein:

a) each of said protrusions includes an arcuate portion.

6. A framing construction as in claim 1, wherein:

a) each of said protrusions includes a triangular surface.

7. A framing construction as in claim 1, wherein:

a) each of said protrusions includes a pair of triangular surfaces connected to each other along a common side.

8. A framing construction as in claim 1, wherein:

a) each of said protrusions is formed by cutting a slot on said track and stud sidewalls; and b) deforming a portion of each of said sidewalls above said slot inwardly into the respective track and stud.

9. A framing construction as in claim 1, wherein:

a) each of said protrusions includes a base portion extending away from the respective track and stud sidewall.

10. A framing construction as in claim 1, wherein:

a) said track protrusions are evenly spaced along the length of said track.

11. A framing construction as in claim 1, wherein:

a) said track sidewalls are resiliently biased inwardly.

12. A stud wall framing construction, comprising:

a ) a lower track;

b) an upper track aligned with and vertically spaced from said lower track;

c) a plurality of vertically aligned studs positioned between said lower and upper tracks;

d) each of said studs having end portions positioned within said lower and upper tracks;

e) each of said lower and upper tracks including a channel having opposed track sidewalls and a track base wall;

f) each of said track sidewalls having a plurality of inwardly projecting prefabricated protrusions, each of said protrusions on one of said track sidewalls being paired with another protrusion disposed on the opposite track sidewall, each of said protrusions including a ramp portion;

g) each of said end portions of said studs including opposed stud sidewalls and a stud base wall;

h) each of said stud sidewalls having a plurality of prefabricated cavities, each of said cavities on one of said stud sidewalls being paired with another cavity disposed on the opposite stud sidewall; and i) said protrusions and cavities are adapted such that each of said pairs of protrusions nest into a respective said pair of cavities, thereby locking said studs in said lower and upper tracks.

13. A framing construction as in claim 12, wherein:

a) each of said lower and upper tracks is substantially "U"-shaped in cross-section.

14. A framing construction as in claim 12, wherein:

a) each of said studs is substantially "U"-shaped in cross-section.

15. A framing construction as in claim 12, wherein:

a) each of said protrusions is formed from the respective track sidewall.

16. A framing construction as in claim 12, wherein:

a) each of said protrusions includes an arcuate portion.

17. A framing construction as in claim 12, wherein:

a) each of said protrusions includes a triangular surface.

18. A method for constructing a stud wall frame, comprising the steps of:

a) providing a substantially "U"-shaped lower track having opposed sidewalls and a base wall;

b) providing a substantially "U"-shaped upper track aligned with the lower track and having opposed sidewalls and a base wall;

c) forming a plurality of inwardly extending prefabricated protrusions on the sidewalls of the lower and upper tracks such that one protrusion on one sidewall is paired with another protrusion on the opposite sidewall, said forming the protrusions being performed by cutting a slot into the respective sidewall of the tracks and deforming the sidewall above the slot inwardly into the track;

d) providing a plurality of substantially "U"-shaped studs having opposed sidewalls and a base wall;

e) forming prefabricated cavities at the sidewalls of the stud end portions, the cavity on one sidewall of the stud being paired with another cavity on the opposite sidewall, the pair of cavities being adapted to receive the corresponding pair of protrusions formed on the tracks; and f) forcing the end portions of the studs into the respective tracks such that the pair of protrusions on the respective track nest into the pair of cavities on the respective studs, thereby securing the studs between the lower and upper tracks.

19. A method as in claim 18, wherein:

a) said forming the cavities is performed by cutting a slot into the respective sidewall of the studs and deforming the sidewall above the slot inwardly into the stud.

* * * * *